US007152530B2

(12) United States Patent
Schmohl et al.

(10) Patent No.: US 7,152,530 B2
(45) Date of Patent: Dec. 26, 2006

(54) PRINTING FORM AND METHOD FOR MODIFYING ITS WETTING PROPERTIES

(75) Inventors: Andreas Schmohl, Heidelberg (DE); Peter Hess, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 269 days.

(21) Appl. No.: 10/733,487

(22) Filed: Dec. 11, 2003

(65) Prior Publication Data

US 2004/0146649 A1 Jul. 29, 2004

Related U.S. Application Data

(60) Provisional application No. 60/438,674, filed on Jan. 8, 2003.

(30) Foreign Application Priority Data

Dec. 19, 2002 (DE) ..... 102 60 114

(51) Int. Cl.
*B41N 1/14* (2006.01)
*B41C 1/10* (2006.01)

(52) U.S. Cl. ..... 101/467; 101/456; 101/463.1; 101/454; 101/465

(58) Field of Classification Search ..... 101/453, 101/456, 467
See application file for complete search history.

(56) References Cited

U.S. PATENT DOCUMENTS

| | | | | |
|---|---|---|---|---|
| 3,678,852 | A | 7/1972 | Feinleib et al. | 101/465 |
| 4,718,340 | A | 1/1988 | Love, III | 101/116 |
| 6,294,313 | B1 | 9/2001 | Kobayashi et al. | 430/302 |
| 6,410,202 | B1 | 6/2002 | Fleming et al. | 430/270.1 |
| 2002/0035938 | A1 | 3/2002 | Hess | 101/465 |

FOREIGN PATENT DOCUMENTS

| | | |
|---|---|---|
| DE | 10042293 | 3/2001 |
| EP | 0962333 | 12/1999 |
| EP | 1211064 | 6/2002 |
| WO | 9849213 | 11/1998 |
| WO | 0021502 | 4/2000 |
| WO | 0021753 | 4/2000 |
| WO | 0170502 | 9/2001 |

*Primary Examiner*—Judy Nguyen
*Assistant Examiner*—Joshua Zimmerman
(74) *Attorney, Agent, or Firm*—Davidson, Davidson & Kappel, LLC

(57) ABSTRACT

A printing form (10) having a surface (12) of pure silicon or of a silicon ceramic, which bears a pattern composed of hydrophilic and hydrophobic regions, the hydrophilic regions having a first chemical state and the hydrophobic regions having a second chemical state that differs from the first chemical state, in hydrophobic regions, the surface (12) having silicon atoms, to which at least one organic terminal group is attached in each instance. The organic terminal group may be, in particular, an unsubstituted or halogenated aryl terminal group or alkyl terminal group and be attached via an Si—C, Si—O—C or Si—O—Si—C bond. Also a method for modifying the wetting properties of the printing form, the surface (12) being brought into a first chemical state having a first wetting property, and a portion of all regions of the surface (12) being brought into a second chemical state having a second wetting property by modifying the chemical terminal groups of the surface (12).

25 Claims, 3 Drawing Sheets

PRINTING FORM AND METHOD FOR MODIFYING ITS WETTING PROPERTIES

This claims priority to German Patent Application No. 102 60 114.3 filed Dec. 19, 2002 and U.S. Provisional Patent Application No. 60/438,674 filed Jan. 8, 2003, both of which are hereby incorporated by reference herein.

BACKGROUND

The present invention is directed to a printing form having a surface which has inorganically bonded silicon and a pattern composed of hydrophilic and hydrophobic regions, the hydrophilic regions having a first chemical state and the hydrophobic regions having a second chemical state that differs from the first state. The present invention is also directed to a method for modifying the wetting properties of a printing form having a surface which has inorganically bonded silicon, the surface being brought into a first chemical state having a first wetting property, and a portion of all regions of the surface being brought into a second chemical state having a second wetting property by modifying the chemical terminal groups of the surface.

From U.S. Pat. No. 3,678,852, a printing form is known which is coated with an amorphous semiconductor. It discusses using a laser beam to change the disordered amorphous state of the semiconductor into a more highly ordered crystalline state. In the crystalline state, the semiconducting surface is rougher so that the reordering of the semiconducting surface results in liquids adhering better in the region of the rougher surface than in the amorphous smooth regions. A printing form produced in accordance with this method is limited by the minimum size of the crystalline regions.

From the document WO 00/21753, it is known that a printing form which has a surface having silicon can be brought into a first chemical state having a first wetting property and into a second chemical state having a second wetting property. The local wetting property, thus the local hydrophilic or hydrophobic wetting property of the printing form, can be controlled by altering the chemical terminal groups of the surface having correspondingly different electronic properties. For this purpose, a surface having a first chemical structure is produced, which preferably has an essentially uniform hydrophilic or hydrophobic wetting property. This surface is then converted in localized areas by a localized modification of the chemical structure (terminal groups) into the respective other state of the wetting property, thus from hydrophilic to hydrophobic or from hydrophobic to hydrophilic.

In a preferred specific embodiment, silicon is selected as a semiconductor in the document WO 00/21753. The surface is first brought into a hydrophobic state, SiH, $SiH_2$ and/or $SiH_3$ groups being present at the surface. To modify the hydrophobic behavior, the hydrophobic terminal group is then exchanged locally, i.e. in individual regions, for a hydrophilic terminal group or converted into such a group, so that, for example, SiOH, SiOSi and/or SiO terminal groups replace the hydrophobic terminal groups.

SUMMARY OF THE INVENTION

An object of the present invention is to propose an alternative printing form having regions of higher hydrophobicity or regions in a strongly hydrophobic state, and to provide a method for locally and repeatedly modifying their wetting properties.

A printing form according to the present invention, in particular an offset printing form, has a surface which has inorganically bonded silicon and a pattern composed of hydrophilic and hydrophobic regions, the hydrophilic regions having a first chemical state and the hydrophobic regions having a second chemical state that differs from the first chemical state. The printing form according to the present invention is distinguished in that, in at least one of the hydrophobic regions, preferably in all hydrophobic regions, the surface has silicon atoms, to each of which at least one organic terminal group is attached, preferably, in each instance, a number of a specific organic terminal group. The silicon atoms are substituted not only exactly with one $CH_3$ group or with one $OCH_3$ group.

The organic terminal group preferably has not only exactly one $CH_3$ group when the sum of the atomic weight of the atoms attached to the silicon atoms in the terminal group is less than 33.5 u. The sum of the atomic weight of the atoms, which are not silicon atoms, attached to the silicon atoms in the terminal groups is preferably greater than 33.5 u, in particular the organic terminal group may be heavier than 33.5 u. The atomic weight is indicated in relative atomic weight units u. A methyl terminal group has approximately 15 u atomic weight units, a methanol terminal group approximately 31 u, a fluorine atom approximately 19 u.

Besides the carbon derivatives typically characterized as organic terminal groups by one skilled in the art, in connection with the inventive idea, an organic terminal group may also be a terminal group which includes a non-organic base chain, in particular an Si—O chain, organic substituents, in particular $CH_3$ groups, being attached to valences or bonding regions of the base chain.

In hydrophobic regions, the printing form according to the present invention advantageously has highly hydrophobic terminal groups. In particular, a plurality of organic terminal groups may be substituted in such a way that the wetting property, the hydrophobicity, of the partial region of the surface is defined by the property of the organic terminal group. The extent to which the wetting properties of the hydrophilic and hydrophobic regions differ may vary greatly depending on the selection of an organic terminal group, in particular, the difference may represent a substantial contrast or be quite pronounced. The organic terminal group may be produced by a reactant or be derived from a reactant.

The surface of the printing form having inorganically bonded silicon may be made up of pure silicon, amorphous, nanocrystalline, polycrystalline or crystalline. Besides pure silicon, however, silicon nitride ceramics or their layered systems may also be used.

In particular, the silicon is not organically bonded as a copolymer to a carbon macromolecule. The silicon nitride ceramics may be stoichiometrically composed of $Si_3N_4$ or non-stoichiometrically of silicon nitride ($Si_xN_y$). The silicon nitride ceramics may be amorphous. In addition, the surface of the printing form may be composed of a stoichiometric or non-stoichiometric silicon oxide ceramic (glass ceramic) or of a mixed phase of silicon, oxygen and nitrogen, of a silicon oxynitride ceramic ($Si_xO_yN_z$). The silicon is inorganically bonded in ceramic form as well. On surfaces of this kind, it is advantageously possible to implement and/or control a great variety in the selection and possible arrangements of organic terminal groups. Silicon nitride ceramics, in particular, may have a greater mechanical strength than pure silicon.

One advantageous specific embodiment provides for the surface of the printing form according to the present invention to be accommodated as a thin amorphous film on a metallic carrier which has titanium (preferably), aluminum, chromium or gold, for example. In particular, the carrier may be a sheet metal, such as titanium sheet metal. The carrier may be plate-shaped, cylindrical or sleeve-shaped. The amorphous film is less than 500 micrometers thick, preferably the film thickness is 0.5 to 10 micrometers. Alternatively, the printing form may also be completely made of the amorphous material. A hydrophilic state of a surface which has inorganically bonded silicon may be realized by oxide terminal groups and/or hydroxide terminal groups, such as silanol groups (SiOH). Typically, such a surface has a plurality of OH groups per square nanometer ($nm^2$). Surfaces containing silicon nitride ceramics have, in addition to silanol groups, also hydrophilic silyl amine terminal groups (—$SiNH_2$, ═SiNH) occurring at the surface. This state of pronounced hydrophilicity may be achieved by wet-chemical reactions, as described, for example, in the document WO 00/21753, whose disclosure is incorporated herein by reference, or by thermal heating or photochemically, for example by ozonization in a normal atmosphere having oxygen and/or water molecules, or by photodissociation. For thermal heating, a laser light source which emits in the infrared or visible spectral region may preferably be used. A photochemical conversion may be effected by UV irradiation or VUV irradiation (vacuum ultraviolet irradiation at a wavelength smaller than 200 nm, in particular larger than 100 nm).

A hydrophobic state of a surface having inorganically bonded silicon may be effected by hydrogen termination, for example SiH, $SiH_2$ and/or $SiH_3$ groups (hydrosilanes). In accordance with the present invention, the surface containing silicon may be brought into a strongly hydrophobic state in that a termination is carried out with the aid of methyl terminal groups, in particular —$Si(CH_3)_3$, —O—$Si(CH_3)_3$ or ≡$SiC(CH_3)_3$, or a termination by unsubstituted and/or partially or completely halogenated, in particular chlorinated or fluorinated alkyl terminal groups, for example $CF_3$ groups. In hydrophobic regions, silicon atoms at the surface may carry a plurality of organic terminal groups. In other words, a silicon atom at the surface may be polysubstituted. The organic terminal groups in hydrophobic regions may have, in particular, less than 21 carbon atoms. In other words, the number of carbon atoms may be a natural number from the interval of 1 through 20 (with interval boundary). In particular, 1 through 6 carbon atoms may preferably be present in a chain of the organic terminal group. Short chains are preferred because less time and a smaller amount of energy are needed for removal.

In hydrophobic regions of the printing form according to the present invention, organic terminal groups, in particular ring- or chain-shaped terminal groups, may be attached by an Si—C bond and/or Si—O—C bond and/or an Si—O—Si—C bond.

Also provided in the context of the inventive idea is a method according to the present invention for modifying the wetting properties of a printing form having a surface which has inorganically bonded silicon, the surface (preferably all regions of the surface which form a printing surface) being brought into a first chemical state having a first wetting property, and a portion, in particular a portion of all regions of the surface being brought into a second chemical state having a second wetting property by modifying the chemical terminal group of the surface. The method according to the present invention is distinguished in that organic terminal groups are attached to silicon atoms at the surface in such a way that the silicon atoms are substituted not only exactly with one $CH_3$ group or with one $OCH_3$ group. In particular, the sum of the atomic weights of the atoms, which are not silicon atoms, bonded to the silicon atoms at the surface, may be greater than 33.5 u. In particular, either the first wetting property may be hydrophilic and the second wetting property hydrophobic, or the first wetting property hydrophobic and the second wetting property hydrophilic.

The method according to the present invention may be carried out quite beneficially using a printing form whose surface is made of amorphous, nanocrystalline, polycrystalline or crystalline silicon, or which is a stoichiometric or non-stoichiometric silicon ceramic containing oxygen and/or nitrogen. The method according to the present invention enables unsubstituted and/or halogenated, for example partially and/or completely chlorinated and/or partially fluorinated and/or completely fluorinated terminal groups, in particular aryl terminal groups or alkyl terminal groups to be bonded as organic terminal groups in hydrophobic regions of the printing form. In particular, the organic terminal groups in the hydrophobic regions may be $CH_3$ terminal groups and/or $CF_3$ terminal groups. The chain molecules may include $CH_3$ terminal groups and/or $CF_3$ terminal groups, in particular.

The purpose of the method according to the present invention for modifying the wetting properties of a printing form is to produce a structure of hydrophilic and hydrophobic regions on the printing form in a way that will allow the structure to be duplicated in an offset printing process. In accordance with the present invention, the method for modifying the wetting properties provides for bringing about the second chemical state by localized processing using a controlled light source in such a way that the second chemical state corresponds to an image information to be printed or to its negative (an image information that is not to be printed).

A direct bonding of alkyl groups or fluoralkyl groups to the surface of the printing form via Si—C bonds may be accomplished by photoinitiation of halogenosilanes, such as Cl—$Si(CH_3)_3$, alcohols, alkenes and/or alkynes. In solution, a bonding to reactive halogen-containing molecules such as iodoform is possible.

Alkoxyl monolayers, in other words alkyl groups, which are fixed via Si—O—C bonds to the surface, may be obtained via reactions of alcohols (R—OH), preferably having four or five carbon atoms in a chain, since these substances are not very dangerous to people or the environment, or of aldehydes (R—CHO), with a hydrogen-terminated, halogen-terminated, or oxide-terminated surface, which has silicon. In this case, R is an unsubstituted alkyl group or aryl group or a partially or completely fluorinated alkyl group or aryl group. The hydrocarbon group may be chain-shaped or ring-shaped, in particular aromatic, for example a phenyl ring ($C_6H_5$—) or a substituted phenyl ring. The reaction may be initiated and/or accelerated by the action of light, preferably UV light, for photochemical activation. The chain-shaped or ring-shaped aromatic unsubstituted or fluorinated carbon terminal groups may have a different number of carbon atoms, preferably 1 through 6 carbon atoms.

Alternatively, alkyl groups may be bonded via Si—O—Si—C bonds using siloxane chemistry to alkylchlorosilanes, alkylalkoxysilanes, and/or alkylaminosilanes at an oxide-covered surface containing silicon. The unsubstituted or fluorinated alkyl group may have a chain of a plurality of carbon atoms, preferably 1 through 6 carbon atoms, to which a $CH_3$ or a $CF_3$ terminal group or a plurality of $CH_3$ or $CF_3$ terminal groups are attached. In other words, in at least one of the hydrophobic regions, the organic terminal groups each have a chain of a plurality of carbon atoms, to which $CH_3$ or $CF_3$ groups are attached. The hydrophobic behavior is influenced only little by the length of the carbon chain. When working with long chains (up to 20 carbon atoms), given a high enough surface density of the organic terminal groups and a suitable chain structure, an additional stabilization may advantageously result from lateral van der Waals interactions; a self-assembled monolayer (SAM) may form. For the printing process, however, a short carbon chain and an arrangement where not every surface atom has an organic terminal group, already suffice. In other words, the arrangement may have a relatively low surface density of the organic terminal groups. Typical concentrations are between $10^{14}$ and $10^{11}$ terminal groups per $cm^2$. Depending on the chain length, a high enough concentration must be achieved in order to attain a strong enough hydrophobicity. At the same time, the concentration should be as low as possible or necessary, since a subsequent removal of the organic terminal groups is advantageously facilitated when working with small terminal group molecules and/or a low surface density.

A higher reaction rate may be achieved when bonding methyl-containing and/or methylene-containing and/or fluorine-containing hydrophobic organic terminal groups at the surface of a printing form in a reaction with substantially more reactive, in particular radical starting molecules. For example, an organic terminal group may be bonded by reaction with iodoform and/or with trimethylenemethane derivatives, which may occur in a triplet and/or in a dipolar singlet state. For the practical handling of such reactive substances, it is advantageous to use a stable precursor molecule. This is advantageously 1,1-dialkoxy-2-methylenecyclopropane (DMCP). From methylenecyclopropane derivatives, dipolar trimethylene derivatives may be produced by thermal or irradiation processes. Further advantages, advantageous specific embodiments and further refinements of the present invention are described on the basis of the following examples.

The first example relates to a bonding of a hydrophobic layer to alkyl terminal groups or fluoroalkyl terminal groups through Si—C bonds. The Si—C bonds exhibit a relatively high stability.

Reactive hydrocarbons, such as alkenes and/or alkynes, may be deposited through photoactivation directly on silicon while forming Si—C bonds (≡Si—R). In other words, R terminal groups are formed at or bonded to silicon surface atoms, R signifying an aryl group or an alkyl group. The starting point for such a bonding may quite advantageously be a hydrogen-terminated silicon surface. The document WO 00/21753 describes a method for obtaining a hydrogen-terminated silicon surface of this kind. This document is incorporated by reference in the disclosure of this specification. The problem of the relatively slow course of the reaction, during which, under normal conditions, a partial oxidation of the silicon surface may set in at the same time, may be countered by using pure chemicals and reactive precursor molecules, such as free radicals. When reactive precursor molecules of this kind are used, the alkylation process is considerably accelerated.

Starting out from a substantially uniform, stable termination of the surface using aryl groups or alkyl groups or fluorinated aryl groups or alkyl groups, for purposes of imaging using laser irradiation, the surface may be oxidized and thus hydrophilized in a spatially selective manner, thus in partial regions. Finally, the image may be erased in that the entire surface is oxidized and/or again hydrogen-terminated, returning it to its original state.

In a first specific embodiment of an imaging method using hydrophilic domains, i.e., for changing the wetting property from hydrophobic to hydrophilic, using a laser in the infrared, visible or ultraviolet spectral region in the atmosphere, aryl terminal groups and alkyl terminal groups, respectively, in particular methyl terminal groups and fluormethyl terminal groups, respectively, are oxidized and removed, possibly not always completely, but only partially, depending on the irradiation time, radiant power and wavelength, with increasing number of the carbon atoms in the organic terminal group. The remaining methylene, methyl or fluormethyl terminal groups are oxidized in this case to aldehyde or carboxyl groups and, thus, likewise become hydrophilic. A switch from hydrophobic to hydrophilic is also possible in that the organic terminal group, for example $CH_3$, of the organic chain is converted without completely removing the organic chain.

If very simple terminal-group molecules and/or a UV laser or a VUV laser (vacuum UV, thus, in particular, having a wavelength shorter than 200 nm) are used, then an alternative second, effective, specific embodiment of the imaging method provides for the entire terminal group to be removed very quickly up to the silicon or the Si—O—Si bonds, during the imaging step employing hydrophilic domains or partial regions, in that all C—C and C—H bonds are dissociated and oxidized by photodegradation. Due to the co-action of oxygen, mainly $H_2O$ and $CO_2$ and potentially CO, as well, are produced as volatile reaction products of the induced free-radical reactions. On the silicon surface liberated in such a way of organic terminal groups, hydrophilic groups, such as silanol groups, are formed. When a surface of a silicon nitride ceramic is used, silyl amine groups may also additionally form. Thus, to facilitate removal, it is practical to select the alkyl groups to be as short-chain as possible. Preferred are chain lengths of 1 to 5 carbon atoms. For a new imaging operation, the alkyl groups are completely removed. A removal process may be carried out photochemically using UV or VUV light sources, in particular lasers, or photothermally using infrared or visible light sources, in particular lasers.

A second example relates to the bonding of a hydrophobic layer to aryl or alkyl terminal groups and fluoroalkyl terminal groups, respectively, through Si—O—C bonds.

As the result of reactions of primary alcohols (R—OH) and/or secondary alcohols ($R—(OH)_2$) and/or aldehydes (R—CHO) with a hydrogen-terminated, halogen-terminated, or oxide-terminated silicon surface, the aryl residue or alkyl residue and fluoroalkyl residue, respectively, are bonded to the surface via an oxygen bridge to the carbon (Si—O—R). Thus, a hydrophobic surface having aryl or alkyl terminal groups and fluorinated alkyl terminal groups, respectively, is formed which, as already described in the first example, may be imaged with hydrophilic regions.

Secondary alcohols having three or four carbon atoms are preferred. Under certain conditions, the secondary alcohols may form O-bridge-type bonds between two organic terminal groups, imparting additional stability to the modified surface. In accordance with the processes described in the first example, the original termination may be regenerated.

The third example relates to a bonding of a hydrophobic layer to aryl or alkyl terminal groups and fluoroalkyl terminal groups, respectively, through Si—O—Si—C bonds.

The starting point is an oxidized hydrophilic silicon, silicon oxide, or silicon nitride surface, which is at least partially covered with silanol groups and/or silyl amine groups. On this surface, molecules having hydrophobic alkyl terminal groups or fluorinated alkyl terminal groups are chemisorbed (Si—O—Si—R). This hydrophobic surface may be produced using alkyltrimethoxysilanes, for example $CH_3$—$(CH_2)_2$—Si—$(OCH_3)_3$, or fluoroalkylmethoxysilanes, for example $CF_3$—$(CH_2)_2$—Si—$(OCH_3)_3$. In the process, the silicon atoms of the Si—O—Si anchoring group may additionally be cross-linked among themselves via oxygen bridges. Alternatively, halogen atoms or $NR_2$—, OH or OR groups of mono-, di- or trifunctional alkyldimethylsilanes react, forming alkyldimethylsilyl groups (Si—O—Si—$(CH_3)_2$—R, in particular Si—O—Si—$(CH_3)_3$), for example. In this context, it is not necessary for the surface density of the anchoring or of the terminating organic terminal group molecules to correspond to the density of the silicon surface atoms, rather it may be lower. A higher reaction rate for hydrophobing of the surface may be achieved using unsaturated compounds, such as trimethylenemethane derivatives. An imaging of the hydrophobic printing form in hydrophilic partial regions or domains may be accomplished by lasers, as already described with respect to the first example. The original hydrophilic state is regenerated by a light-induced, in particular laser-induced oxidation of the entire surface.

BRIEF DESCRIPTION OF THE DRAWINGS

Further advantages, advantageous specific embodiments and further refinements of the present invention are described with reference to the following figures, as well as their descriptions, in which.

DETAILED DESCRIPTION

Figure 1:
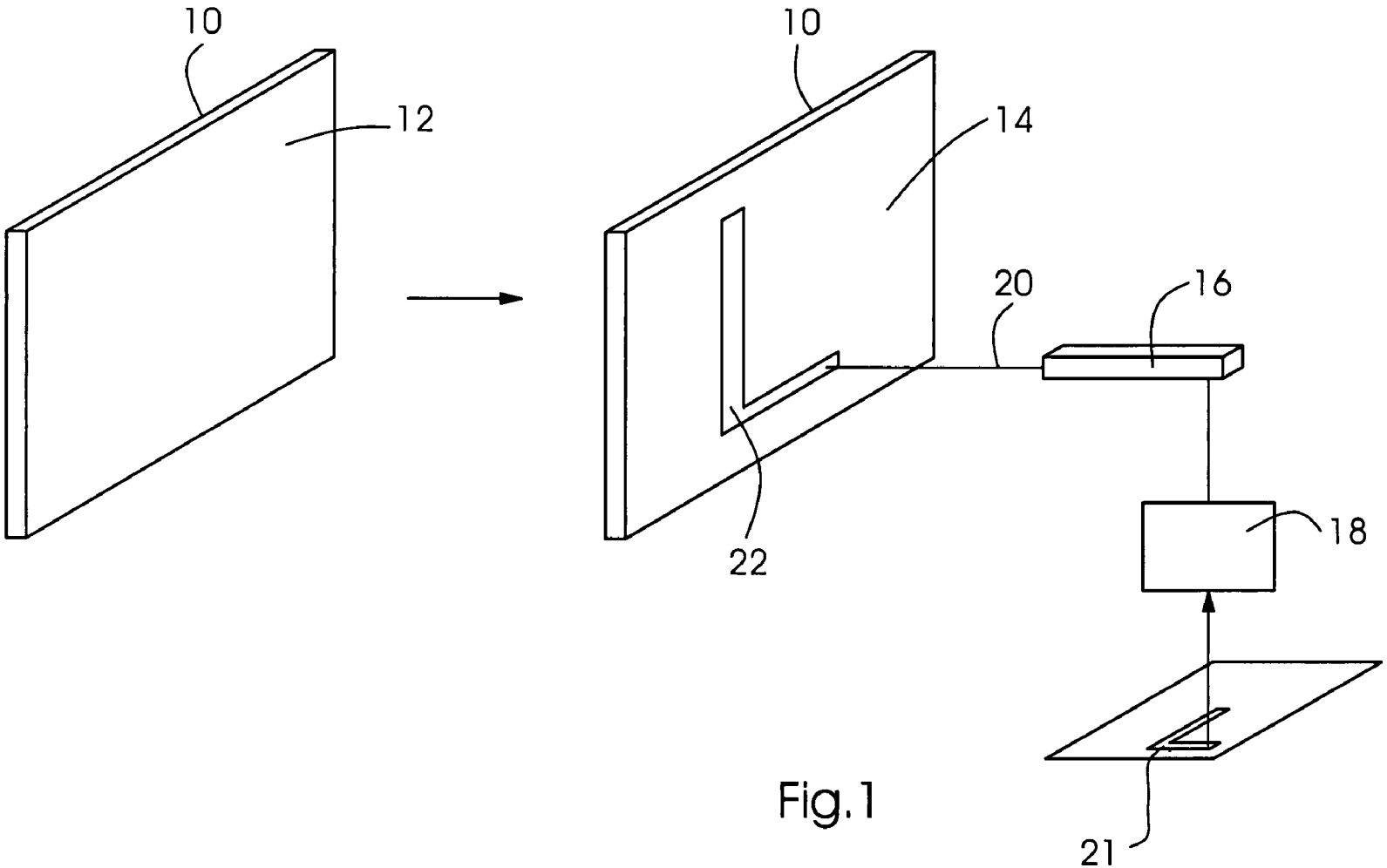
FIG. 1 is a schematic representation of the method according to the present invention.

In FIG. 1, the method according to the present invention is schematically shown. A printing form 10 has a plate-shaped design and may be accommodated on a printing-form cylinder, in particular in a printing press. Printing form 10 has a surface 12 which has inorganically bonded silicon. In its original state, especially following its manufacturing process, this printing form 10 is typically covered with a native oxide layer having a thickness of a few nanometers.

In a first method step according to the present invention, printing form 10 is provided with a defined, substantially hydrophobic surface. For this purpose, surface 12 of printing form 10 is terminated using organic terminal groups or fluorinated organic terminal groups. The free valences of the silicon surface atoms are saturated by the corresponding terminal groups, in particular aryl terminal groups, alkyl terminal groups or fluoralkyl terminal groups.

At this point, hydrophobic region 14 of printing form 10 is hydrophilized in partial regions, in a further process step. This may be accomplished, for example, by one of the chemical reactions indicated above, in particular in accordance with Examples 1 through 3. Two methods have proven to be especially suitable for locally modifying hydrophobic surface 14. As shown exemplarily in FIG. 1, local energy may be supplied via a laser 16 in order to trigger the chemical conversion process. Particularly suited for this are lasers (in continuous-wave or pulsed operation) which have a small beam cross section, enabling the chemical conversion to be carried out in a spatially limited area. This area may be smaller than the beam cross section. For example, a fluorine laser produces VUV light having a wavelength of approximately 157 nm. Alternatively, light having a short wavelength in this spectral region may be produced in non-linear optical processes from light having a longer wavelength. Using this laser or some other short-wave radiation source, a photochemical surface modification may be achieved. To achieve a photothermal modification, as already mentioned above, a multiplicity of light wavelengths is possible. For example, gas lasers (excimer lasers) or solid-state lasers (for example, frequency-multiplied Nd lasers) or diode lasers may be used.

Laser 16 is driven by a control unit 18. A device is provided for producing a relative movement between laser 16 and printing form 10 in such a way that light beam 20 emitted by laser 16 is able to sweep over or reach all points on the surface of printing form 10 which constitute the printing surface. For example, printing form 10 may be mounted or accommodated on a printing-form cylinder in a printing press, so that, as a result of the rotation of the cylinder about its axis of symmetry and a translation of laser 16 substantially in parallel to the axis of symmetry of the cylinder, light beam 20 is able to sweep over the entire surface of printing form 10. Light beam 20, respectively laser 16, while being guided over the printing form, is switched on and off or is focused and masked out, so that a pattern 22 to be printed or the negative of the pattern may be introduced as a hydrophilic image in the hydrophobic surface. Normally, this change in the molecular property on the surface of printing form 10 is not discernible with the naked eye, since it is a microscopic modification of the surface. The applied pattern 22 to be printed corresponds to a master image 21, which may be produced in different ways. For example, a master image 21 may be produced using a digitization method or directly, for example with the aid of a graphics program or a digital camera. Typically, master images 21 are processed and stored in a so-called RIP (raster imaging processor). The memory may be situated inside control unit 18 or externally therefrom. On the basis of the data ascertained and stored in the RIP, light beam 20 is then controlled in such a way that pattern 22 to be printed is applied to printing form 10.

To erase a hydrophilic image produced in this manner in a structured surface 14, in another process step in a first specific embodiment, energy may be locally supplied by laser 16 to all other points of hydrophobic surface 14, so that the entire surface of printing form 14 is ultimately hydrophilized and thus modified, in particular uniformly hydrophilized or rendered unstructured. In a second specific embodiment, energy may be supplied over a wide surface, for instance by a lamp, such as a UV lamp, in particular commercially available excimer lamps having various UV wavelengths.

Figure 2:
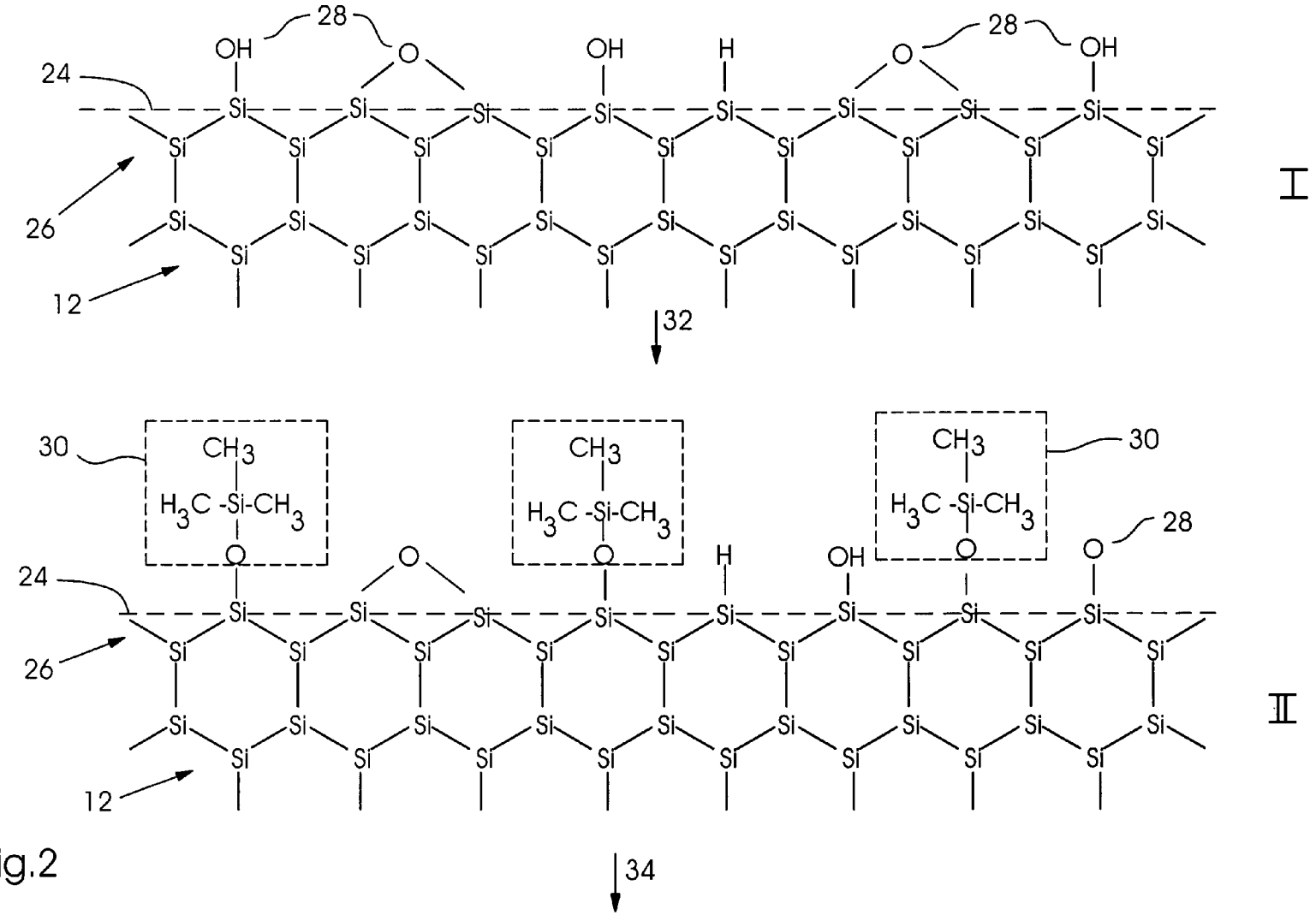
FIG. 2 is a schematic illustration of an especially preferred specific embodiment of the method.
Figure 2:
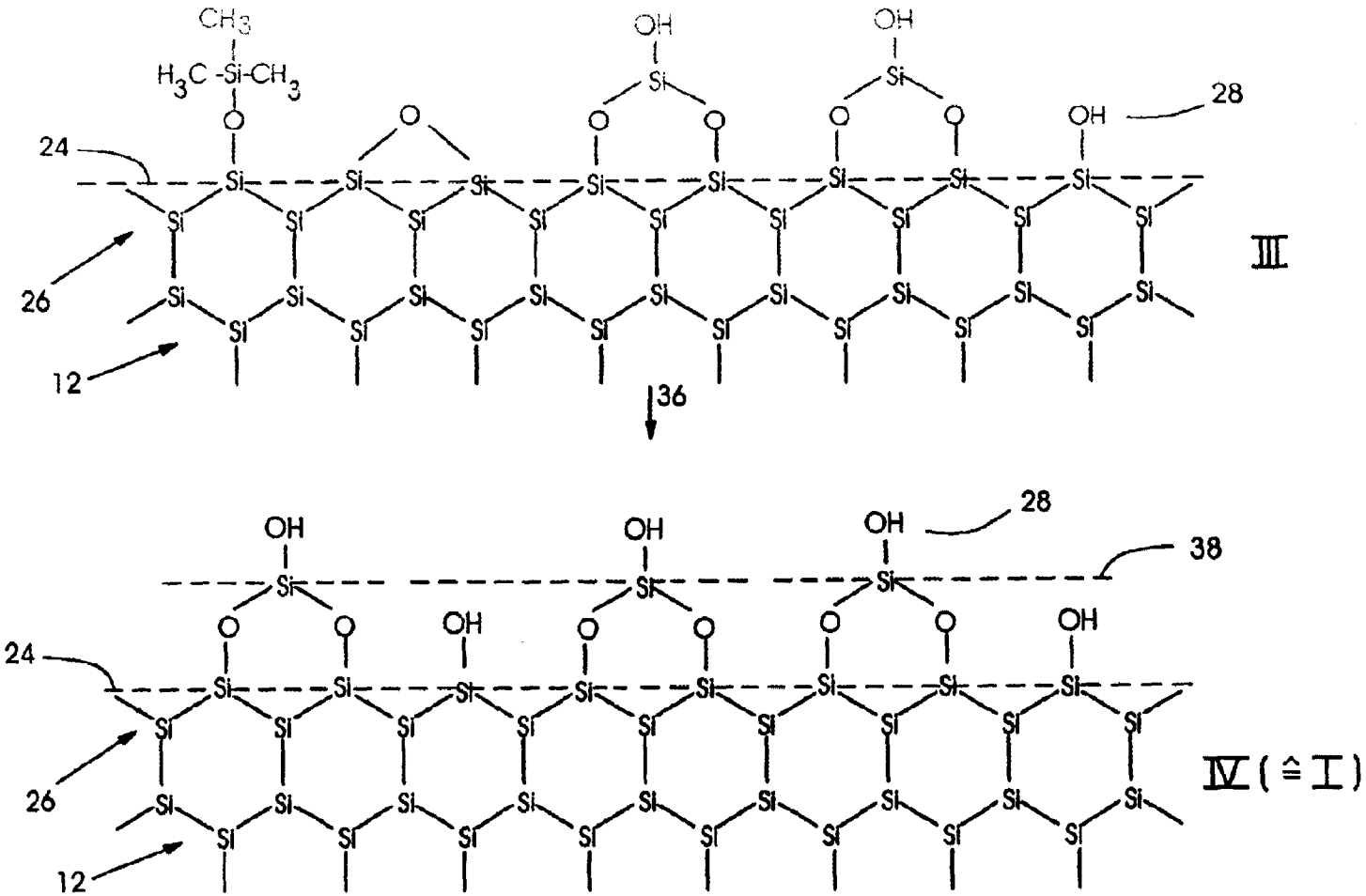

An especially preferred specific embodiment of the method of the present invention using a printing form according to the present invention is elucidated on the basis of FIG. 2. One starts out from a surface 12 having inorganically bonded silicon, which includes silicon (di)oxide (partial image I). By the wording silicon (di)oxide, the intention is to indicate that when working with ultrathin oxide layers of less than 1 nanometer thickness, suboxides $SiO_x$, where $x<2$, are present, and only when working with thicker oxide layers is silicon dioxide ($Si0_2$) present. At the surface line, the surface has an oxidized surface layer 26, whose thickness is typically in the nanometer range. Hydroxyl groups (OH groups) are attached to valences 28 of surface 12. Surface 12 is hydrophilic. A surface 12 of this kind may be obtained in different ways. Surface 12 is able to be obtained indirectly by forming a native oxide layer (spontaneous surface oxidation) of an amorphous silicon layer deposited on a carrier material. A silicon (di)oxide film may be deposited from a liquid phase or gas phase, onto a carrier material. A silicon oxide may also be used as glass. The carrier material, i.e., the glass, may be formed as a plate, cylinder or sleeve, in particular for use in a printing press. The steps described in the following may be carried out in particular in the printing press when the printing form is accommodated in a print unit.

In a subsequent step, surface 12 is cleaned prior to the hydrophobic termination. This is preferably accomplished by large-area irradiation using the VUV light of a lamp having a wavelength of less than 200 nm, preferably 172 nm. The process is self-limiting; at room temperature, the surface coats itself with an oxide layer having a thickness of a few monolayers. Alternatively to irradiation by UV light, a cleaning may also be carried out by a treatment using ozone ($0_3$) or another oxidizing agent, such as concentrated nitric acid ($HNO_3$), hydrogen peroxide solution ($H_20_2$) or the like. Alternatively, a plasma treatment is also effective. Typically, an oxidative cleaning may take about 10 minutes.

As a result of the termination in immediately following step 32, the surface, preferably the entire surface becomes hydrophobic, thus water-repellent. The termination is accomplished using trimethylsilyl derivatives, such as hexamethyldisiloxane, chlorotrimethylsilane, hexamethyldisilazane, ethoxytrimethylsilane or dimethylaminotrimethylsilane.

A termination reaction of this kind may proceed in accordance with a general reaction scheme, as follows:

$$Si—O—H+Y—Si(CH_3)_3 \rightarrow Si—O—Si(CH_3)_3+HY,$$

Y being a suitable leaving group. For example, Y may be an OH group, a halogen atom, an $NH_2$ group or the like. The Si atom not carrying methyl groups is situated in or at surface 12.

Preferred is a preparation mixture of hexamethyldisiloxane, an ethanol that is completely halogenated at the second C atom, and concentrated sulfuric acid (approximately 90%). Especially preferred is a mixture of 1.0 to 1.6 g hexamethyldisiloxane, 4.5 to 8.0 g trifluorethanol and 0.8 to 1.5 g 90% sulfuric acid, in particular 1.3 g hexamethyldisiloxane, 6.0 g trifluorethanol and 1.2 g 90% sulfuric acid. Already for financial reasons, the trifluorethanol concentration should be minimized. When varying the mixing ratio, it must be taken into account that too high a concentration of hexamethyldisiloxane and too low a concentration of the other components will result in a phase separation. If there is too much sulfuric acid, undesired secondary reactions may occur.

To effect termination, the liquid mixture is applied to the purified, oxidized silicon surface. For example, the mixture may be spread onto the surface using a plastic doctor blade. Alternatively, the surface may be slowly bathed in the preparation mixture; be passed through a bath filled with the preparation mixture. The reaction time is approximately 10 seconds. The preparation solution flows off spontaneously from the terminated surface, or collects into small droplets which are rinsed off with water or which may be siphoned off from the surface in accordance with the capillary effect principle.

Alternatively to the described preparation mixture, hexamethyldisilazane may also be used quite advantageously. This substance may be used directly, thus without other components. It may be supplied as vapor to the surface. However, a suction device is useful, since ammonia gas ($NH_3$) may be liberated in the process. Since hexamethyldisilazane has a high vapor pressure, there is no need for a subsequent rinsing of the surface. The reaction time is likewise approximately 10 seconds.

The result of the termination is a surface 12 having inorganically bonded silicon and an oxidized surface layer 26 (silicon(di)oxide), on which hydroxyl groups are substituted by trimethysiloxy groups to such an extent that the surface, as a whole, has hydrophobic properties. In FIG. 2, organic terminal groups 30 are shown in a rough schematic view in partial image II.

In the immediately following step, the hydrophobic termination is locally removed by imaging or energy input, so that a hydrophilic silicon(di)oxide surface forms again at the imaged locations (structuring step 34, partial image III of FIG. 2). Preferably, an imaging operation is carried out using a laser, it being possible to use IR—, NIR—, visible or UV radiation. Underneath the silicon(di)oxide layer, a material having a high absorption coefficient may be used, such as a metallic or ceramic layer, so that the radiation is efficiently absorbed in a small volume. In the visible or UV spectral region, (doped) amorphous silicon may function as an absorbing layer.

Following the structuring into hydrophilic and hydrophobic regions, depending on the image or color separation to be reproduced, the printing form may be printed in an offset printing process using conventional printing ink. Following completion of the printing operation, printing ink residues may be removed by the detergents or solvents customarily used in print shops. Approximately five minutes are needed for an initial cleaning.

Finally, the structuring may be erased: During the erase operation, both organic impurities, such as ink residues or solvent residues, as well as the hydrophobic termination of the surface, are removed (erasing step 36 in FIG. 2). Thus, the purpose of the erasing process is to reconstitute an unstructured hydrophilic surface. In this sense, partial image IV of FIG. 2 corresponds to partial image I of FIG. 2, when organic terminal groups 30 have been removed over a large area and surface 12 again carries OH groups at valences 28. The Si—O part of the organic terminal group may remain, however, at oxidized surface layer 26 of surface 12, so that surface line 24 is replaced by a new surface line 38. In other words, silicon(di)oxide may grow slowly on surface 12, without fundamentally changing the composition or the wetting properties in the process. The erase operation may preferably be carried out by the action of energy using a laser. In other words, an imaging or a purification using UV light is carried out over a large area, as already described above.

With the aid of the described method, in various embodiments, a hydrophobic surface 14 of printing form 10 is able to be converted by local, photo-induced reaction processes in partial regions, into a modified, second chemical state, in particular hydrophilic state. The surface of printing form 10 may also be brought over a large area into either the first chemical state or the second chemical state, so that a pattern 22 to be printed is removed again, and a restructuring may be undertaken. Printing form 10 may also be described as a rewritable printing form or as a reusable printing form. The printing form in accordance with the present invention is an offset printing form, in particular.

REFERENCE SYMBOL LIST

10 printing form
12 surface
14 hydrophobic region
16 laser
18 control unit
20 light beam
21 master
22 pattern to be printed
24 surface line
26 oxidized surface layer
28 valence
30 organic terminal group
32 termination step
34 structuring step
36 erasing step
38 new surface line

What is claimed is:

1. A printing form comprising:

a surface having inorganically bonded silicon and a pattern composed of hydrophilic and hydrophobic regions, the hydrophilic regions having a first chemical state and the hydrophobic regions having a second chemical state differing from the first state;

in at least one of the hydrophobic regions, the surface having silicon atoms, at least one organic terminal group being attached to the silicon atoms of the at least one hydrophobic region in each instance, the silicon atoms being substituted not only exactly with one $CH_3$ group or with one $OCH_3$ group.

2. The printing form as recited in claim 1 wherein the surface is made of amorphous, nanocrystalline, polycrystalline or crystalline silicon, or a stoichiometric or non-stoichiometric silicon ceramic containing oxygen and/or nitrogen.

3. The printing form as recited in claim 1 further comprising a metallic carrier, the surface being an amorphous film on the metallic carrier.

4. The printing form as recited in claim 1 wherein, in at least one of the hydrophilic regions, the surface has silicon atoms, oxide and/or hydroxy terminal groups and/or silyl amine and/or aldehyde terminal groups and/or carboxyl terminal groups being attached to the silicon atoms.

5. The printing form as recited in claim 1 wherein, in at least one of the hydrophobic regions, the organic terminal groups are unsubstituted and/or partially chlorinated and/or completely chlorinated and/or partially fluorinated and/or completely fluorinated terminal groups.

6. The printing form as recited in claim 5 wherein, in at least one of the hydrophobic regions, the organic terminal groups each have a chain of a plurality of carbon atoms, to which $CH_3$ or $CF_3$ groups are attached.

7. The printing form as recited in claim 1 wherein, in at least one of the hydrophobic regions, the organic terminal groups have fewer than 21 carbon atoms.

8. The printing form as recited in claim 1 wherein, in at least one of the hydrophobic regions, the organic terminal groups are attached by an Si—C bond and/or an Si—O—C bond and/or an Si—O—Si—C bond.

9. The printing form as recited in claim 1 wherein, in at least one of the hydrophobic regions, silicon atoms at the surface carry a plurality of organic terminal groups.

10. The printing form as recited in claim 1 wherein, in at least one of the hydrophobic regions, silicon atoms carry three methyl groups or an O—Si—$(CH_3)_3$ group.

11. A method for modifying the wetting properties of a printing form having a surface with inorganically bonded silicon, the method comprising the steps of:

bringing the surface into a first chemical state having a first wetting property;

bringing a portion of the surface into a second chemical state having a second wetting property by modifying chemical terminal groups of the surface;

organic terminal groups being attached to silicon atoms at an hydrophobic area of the surface in such a way that the silicon atoms are substituted not only exactly with one $CH_3$ group or with one $OCH_3$ group.

12. The method as recited in claim 11 wherein either the first wetting property is hydrophilic and the second wetting property hydrophobic, or the first wetting property hydrophobic and the second wetting property hydrophilic.

13. The method as recited in claim 11 wherein the surface is amorphous, contains nanocrystalline, polycrystalline or crystalline silicon, or is a stoichiometric or non-stoichiometric silicon ceramic with oxygen and/or nitrogen.

14. The method as recited in claim 11 wherein, in at least one of the hydrophobic areas, unsubstituted and/or partially chlorinated and/or completely chlorinated and/or partially fluorinated and/or completely fluorinated alkyl terminal groups are attached as organic terminal groups.

15. The method as recited in claim 14 wherein, in at least one of the hydrophobic area, chains of a plurality of carbon atoms, to which $CH_3$ or $CF_3$ groups are attached, are attached as organic terminal groups.

16. The method as recited in claim 11 wherein the second chemical state is brought about by localized processing using a controlled light source so that the second chemical state corresponds to an image information to be printed or to a negative of the image information to be printed.

17. The method as recited in claim 12 wherein the chemical state having hydrophilic wetting properties is achieved by thermal heating or photochemically.

18. The method as recited in claim 11 wherein aryl groups and/or alkyl groups and/or fluoralkyl groups and/or chloroakyl groups are attached to the surface via an Si—C bond through photoinitiation of halogenosilanes, alcohols, alkenes or alkynes.

19. The method as recited in claim 11 wherein the organic terminal groups are attached through reaction with iodoform and/or trimethylenemethane derivatives and/or methylenecyclopropane derivatives and/or 1,1-dialkoxy-2-methylenecyclopropane (DMCP) and/or trimethylsilyl derivatives.

20. The method as recited in claim 19 wherein the trimethylsilyl derivative is hexamethyldisiloxane or hexamethyldisilazane.

21. The method as recited in claim 11 wherein aryl groups and/or alkyl groups are attached to the surface via an Si—O—C bond as a result of reactions of primary alcohols and/or secondary alcohols and/or aldehydes.

22. The method as recited in claim 21 wherein the reaction is initiated and/or accelerated by the action of light.

23. The method as recited in claim 11 wherein alkyl groups are attached to the surface via an Si—O—Si—C bond through reaction with alkylalkoxysilanes, alkylaminosilanes and/or alkylchlorosilanes.

24. The method as recited in claim 11 wherein alkyl groups are attached via an Si—O—Si—C bond through reaction with alkyltrimethoxysilanes and/or fluoroalkylmethoxysilanes.

25. A printing form comprising:

a surface having inorganically bonded silicon and a pattern composed of hydrophilic and hydrophobic regions, the hydrophilic regions having a first chemical state and the hydrophobic regions having a second chemical state differing from the first state;

at least one of the hydrophobic regions having silicon atoms at the surface having at least one organic terminal group attached thereto, the at least one organic terminal group including one of: at least one organic group other than CH3 and OCH3; a CH3 group and at least one further organic group; and OCH3 and at least one additional organic group;

wherein the surface is made of amorphous, nanocrystalline, polycrystalline or crystalline silicon, or a stoichiometric or non-stoichiometric silicon ceramic containing oxygen and/or nitrogen.

* * * * *